US008919227B2

(12) United States Patent
Tseng

(10) Patent No.: US 8,919,227 B2
(45) Date of Patent: Dec. 30, 2014

(54) PLIERS FOR C-SHAPED LOCK RINGS

(71) Applicant: Min-Cheng Tseng, Nantou (TW)

(72) Inventor: Min-Cheng Tseng, Nantou (TW)

( * ) Notice: Subject to any disclaimer, the term of this patent is extended or adjusted under 35 U.S.C. 154(b) by 243 days.

(21) Appl. No.: 13/655,736

(22) Filed: Oct. 19, 2012

(65) Prior Publication Data

US 2014/0109731 A1 Apr. 24, 2014

(51) Int. Cl.
*B25B 27/14* (2006.01)
*B25B 27/20* (2006.01)

(52) U.S. Cl.
USPC ..... 81/302; 29/229

(58) Field of Classification Search
CPC ..... B25B 27/14; B25B 27/20; B25B 7/02; B25B 7/08; B25B 7/12; B25B 7/14
USPC ..... 81/302, 324; 29/229
See application file for complete search history.

(56) References Cited

U.S. PATENT DOCUMENTS

| | | | | | |
|---|---|---|---|---|---|
| 3,619,890 | A * | 11/1971 | Kubokawa | 29/229 |
| 4,476,750 | A * | 10/1984 | Murphy | 81/300 |
| 4,776,245 | A * | 10/1988 | Gustavsson | 81/302 |
| 5,826,467 | A * | 10/1998 | Huang | 81/302 |
| 6,282,995 | B1 * | 9/2001 | Lin | 81/423 |
| 2011/0154958 | A1 * | 6/2011 | Wang | 81/302 |
| 2011/0214538 | A1 * | 9/2011 | Huang | 81/302 |

* cited by examiner

*Primary Examiner* — David B Thomas

(57) ABSTRACT

Pliers for C-shaped lock rings include a holding unit and a clamping unit. The holding unit is composed of two handles and a control portion. The clamping unit comprises two identical clamping members and a positioning disk. When the control portion is released to engage with the positioning slot to lock the handle; when the control portion is pushed to disengage with the positioning slot, the handle rotate around the center shaft corresponding to the rotations of the clamping unit, such that the clamping members can be open or closed.

3 Claims, 8 Drawing Sheets

4-4

PLIERS FOR C-SHAPED LOCK RINGS

BACKGROUND OF THE INVENTION

1. Field of the Invention

The present invention relates to pliers for C-shaped lock rings, and in particular to pliers suitable for both closing and opening C-shaped lock rings.

2. Description of the Related Art

Currently, pliers for C-shaped lock rings are common hand tools for assembling or disassembling C-shaped lock rings. When the C-shaped lock ring needs to be mounted onto a tube body, external pliers for C-shaped lock rings is utilized to expend open the C-shaped lock ring and then jacket the C-shaped lock ring onto the tube body. When the C-shaped lock ring needs to be mounted in a hole, internal pliers for C-shaped lock rings is utilized to tighten the C-shaped lock ring. However, two different pliers for C-shaped lock rings is very inconvenient for users.

The present invention has provide pliers for C-shaped lock rings to mitigate and/or obviate the afore-described disadvantages.

SUMMARY OF THE INVENTION

An objective of the present invention is to provide pliers for C-shaped lock rings, which are suitable for both closing and opening C-shaped lock rings.

In order to achieve the above-mentioned objective, pliers for C-shaped lock rings include a holding unit and a clamping unit. The holding unit is composed of two handles and a control portion, the handle is provided with a long slot at a side and a pivoting aperture inside the long slot for providing a pivoting point for the control portion. When an external force is applied onto the control portion, the control portion is capable of rotating in the long slot. The clamping unit includes two identical clamping members and a positioning disk, and the clamping member has a first limiting member and a first securing aperture. A ring-holding member is pivoted above the clamping member and has a containment space. The containment space is used for accepting the positioning disk. The positioning disk has a second limiting member, a second securing aperture and a positioning slot on two outer sides of the two clamping members. The positioning disk is locked onto the clamping member. The handle utilizes the center shaft to be pivoted onto the first securing aperture and the second securing aperture such that the handle and the clamping member are pivoted with each other. Accordingly, when the control portion is released to engage with the positioning slot to lock the handle; when the control portion is pushed to disengage with the positioning slot, the handle rotate around the center shaft corresponding to the rotations of the clamping unit, such that the clamping members can be open or closed.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
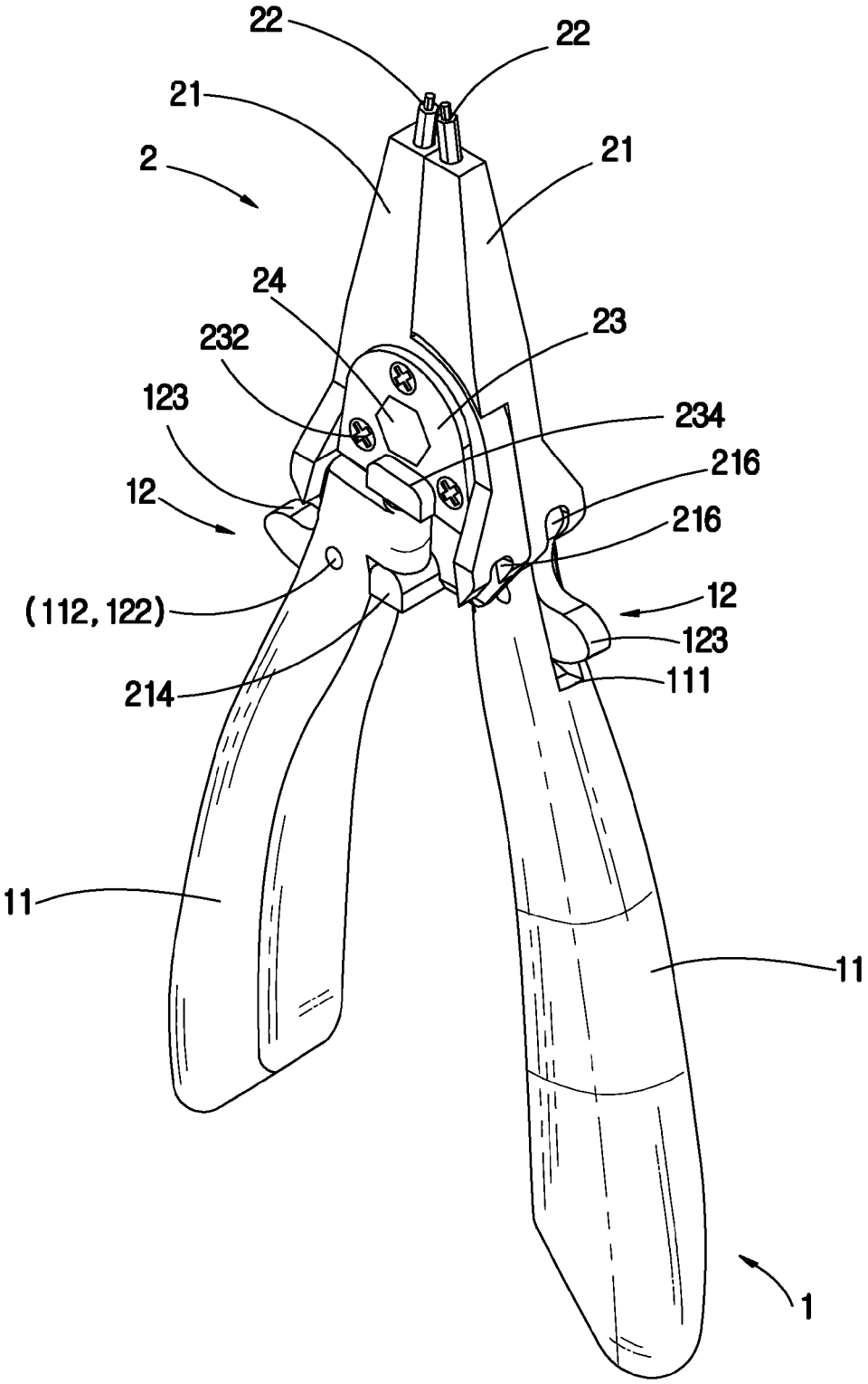
FIG. 1 is a perspective view of an embodiment of the present invention.
Figure 2:
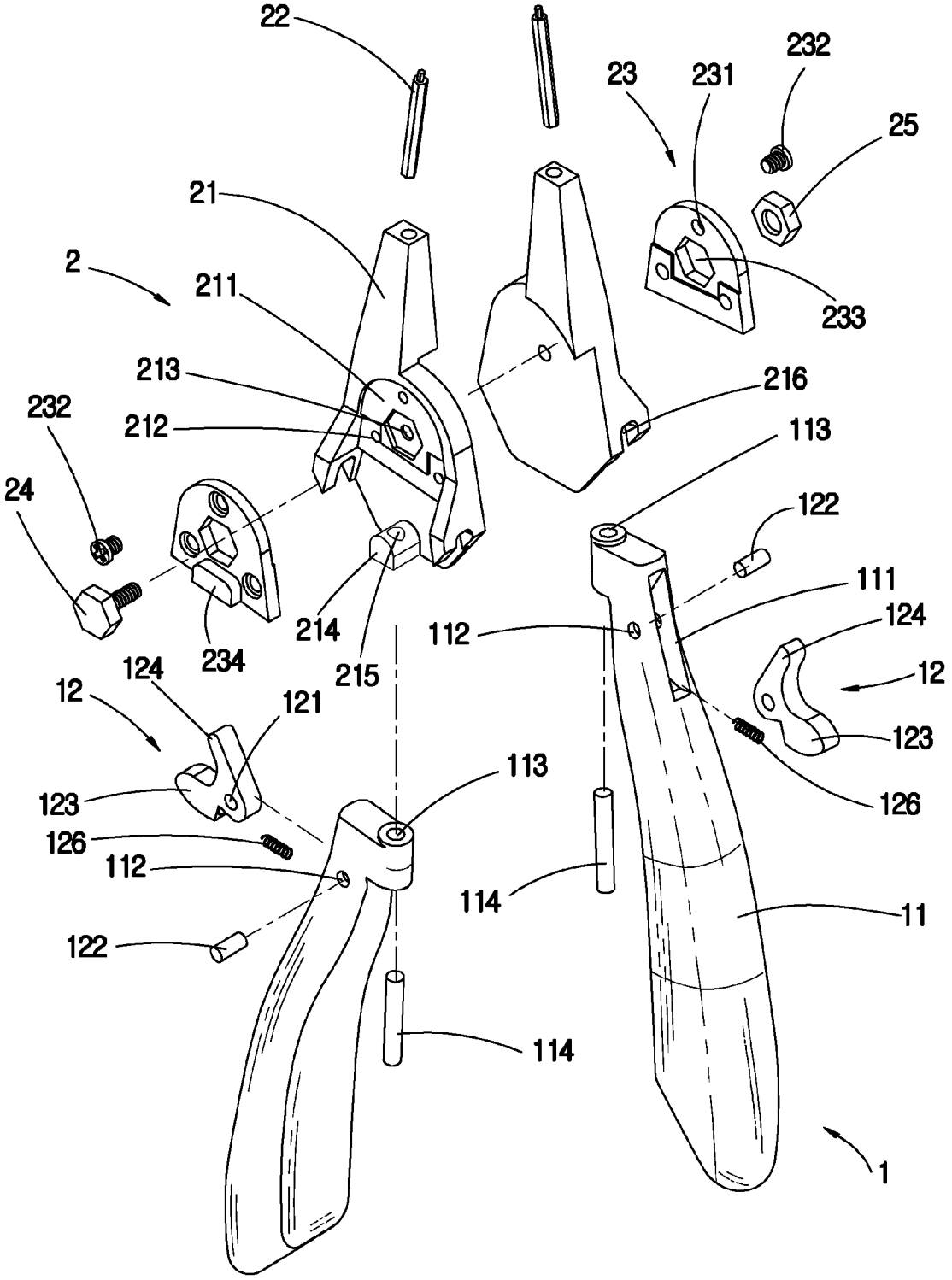
FIG. 2 is an exploded view of the embodiment of the present invention.

Please refer to FIG. 1 to FIG. 10. One preferred embodiment of the present invention provides improved pliers for C-shaped lock rings, which comprising a holding unit 1 and a clamping unit 2.

As shown in FIG. 1 to FIG. 5. The holding unit 1 is composed of two handles 11 and a control portion 12. The two handles 11 sandwich a spring (not shown) in between. The handle 11 is provided with a long slot 111 at a side and a pivoting aperture 112 inside the long slot 111 for providing a pivoting point for the control portion 12. The handle 11 further has a through aperture 113 for accepting a center shaft 114, a length of the through aperture 113 is shorter than the center shaft 114 such that two ends of the center shaft 114 both protrude out of the through aperture 113. The clamping unit 2 comprises two identical clamping members 21 and a positioning disk 23. The clamping member 21 has a first limiting member 214 and a first securing aperture, and a ring-holding member 22*s* pivoted above the clamping member 21 and has a containment space 211. The containment space is used for accepting the positioning disk 23. The positioning disk has a second limiting member, a second securing aperture and a positioning slot on two outer sides of the two clamping members. One end of the center shaft 114 is pivoted onto the first securing aperture 215 of the first limiting member 214 of the clamping member 21, and another end of the center shaft 114 is pivoted onto the second securing aperture 235 of the second limiting member 234 of the positioning disk 23. Therefore, the handle 11 utilizes the center shaft 114 to be pivoted onto the first securing aperture 215 and the second securing aperture 235 and capable of being rotated freely.

The control portion 12 comprises an assembling aperture 121, a positioning rod 122, a trigger 123, a positioning face 124, a groove 125 and an elastic member 126. The assembling aperture 121 is located through a front portion of the control portion 12 and accepts a positioning rod 122 engaged with the pivoting aperture 112 of the handle 11 such that the control portion 12 is accepted in the long slot 111. The groove 123 is disposed at a bottom end of the trigger 123 and used for accepting the elastic member 126. The elastic member 126 is a compress spring, one end is inserted in the groove 125 and another end makes contact with one side of the long slot 111. Therefore, when the trigger 123 id pushed by external force, the control portion 12 can rotate around the positioning rod 122 in the long slot 111, 連 to drive the positioning face 125 of the control portion 12 to engage with or release from the positioning slot 216 of clamping member 21 to secure the handles 11. Furthermore, the control portion 12 is pushed back by the elastic member 126, with the positioning face 124 and the positioning slot 216 of the clamping member 22, the handled 11 can be secured after the rotation.

Figure 3:
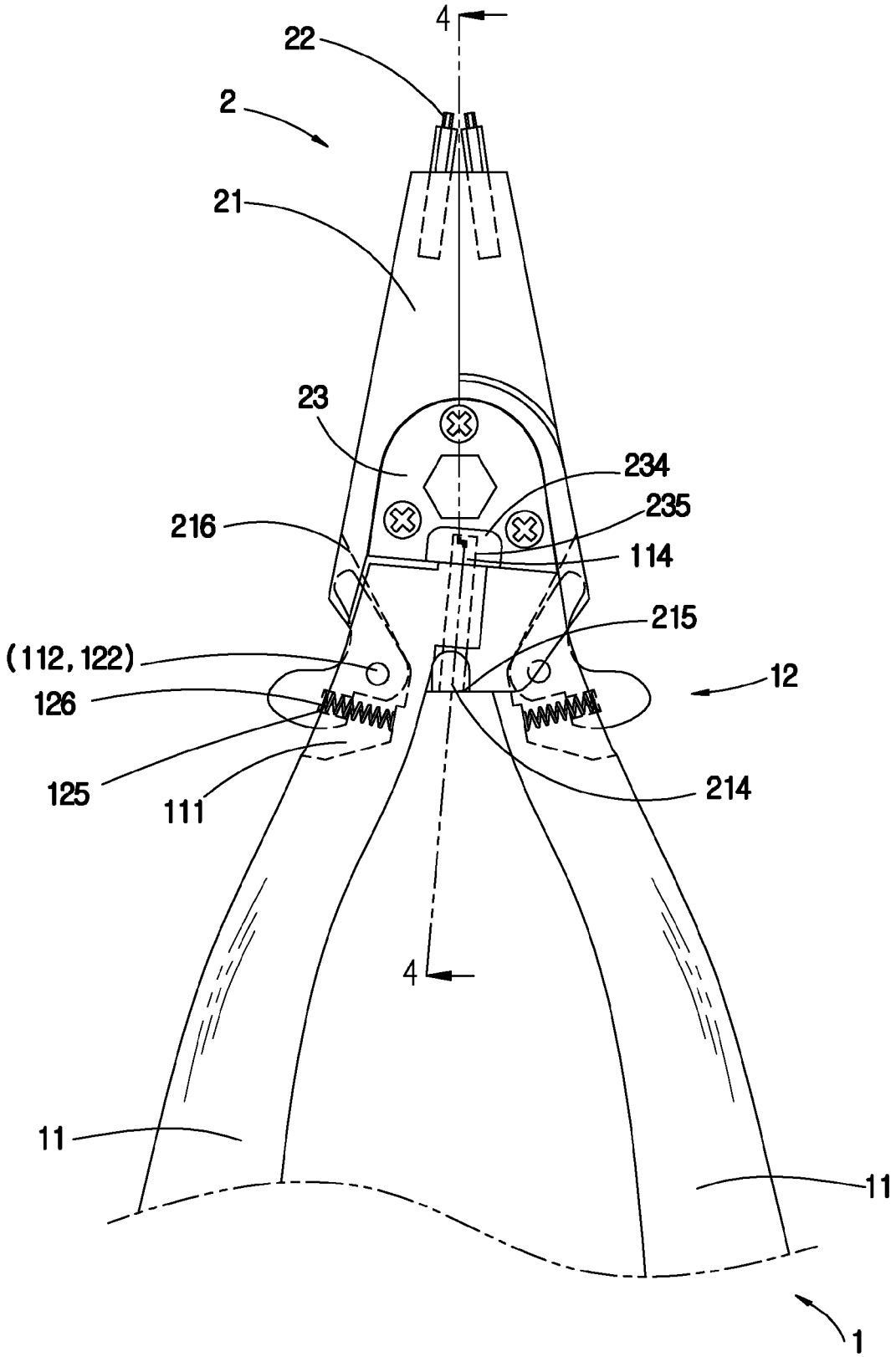
FIG. 3 is a front view of the holding unit and the clamping unit being combined together according to the embodiment of the present invention.
Figure 4:
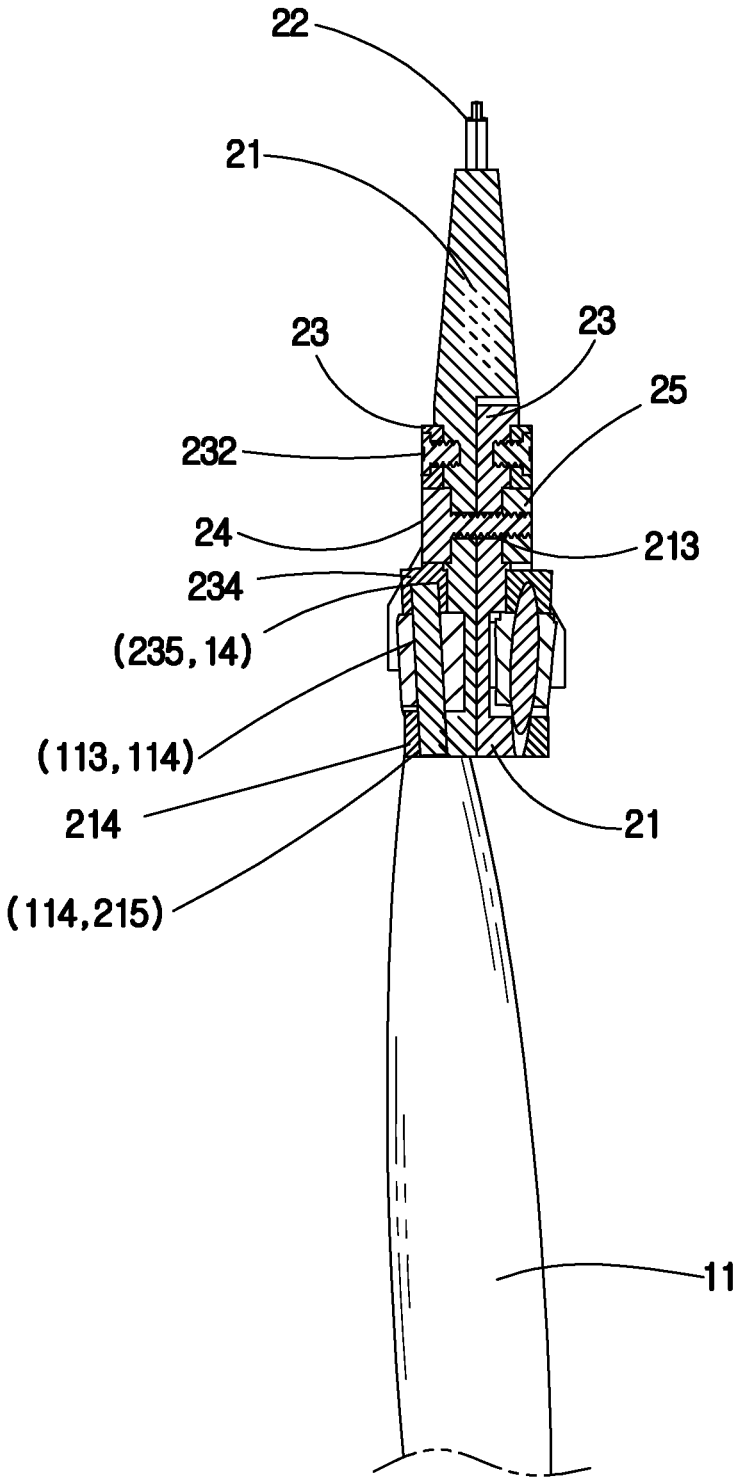
FIG. 4 shows a cross-sectional view along a cutting line 4-4 shown in FIG. 3.
Figure 5:
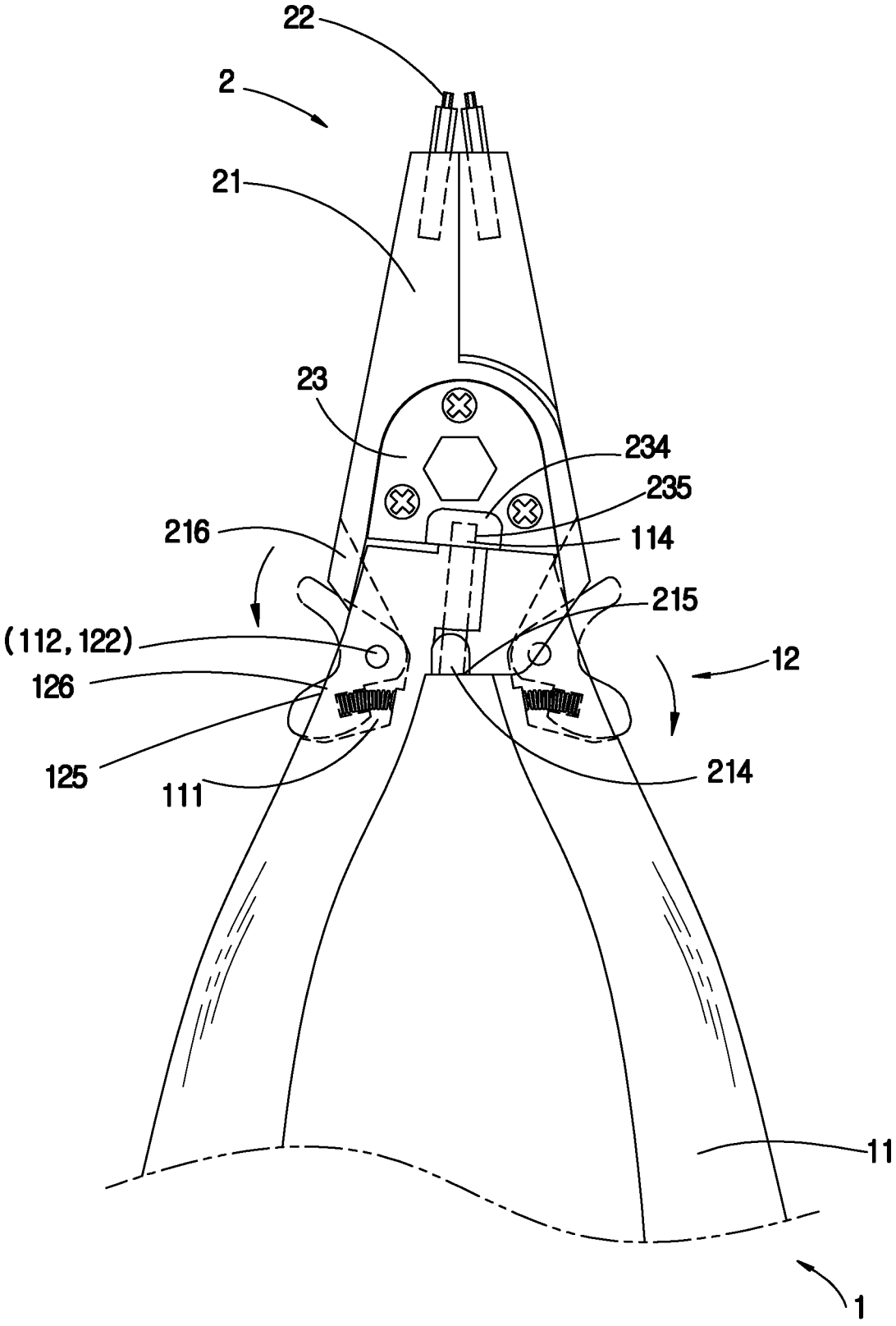
FIG. 5 is a schematic drawing showing the control portion being pushed according to the embodiment of the present invention.

As shown in FIG. 1 to FIG. 5, the clamping unit 2 further comprises a hexagonal bolt 24 and a hexagonal nut 25. There are three securing apertures 212 disposed on the containment space 211 and aligned with three threaded apertures 231 on the positioning disk 23, and three screw bolts 232 are respectively screwed with the threaded apertures 231 and the securing apertures 212 of the clamping member 21, to lock the positioning disk 23 onto the containment space 211 of the clamping member 21. Moreover, a shaft aperture 213 is disposed at a center area among the three securing apertures 212 and used for accepting the hexagonal screw bolt 24. The hexagonal screw bolt 24 and the hexagonal nut 25 are screwed together, such that the two clamping members 21 are overlapped and combined and capable of being rotated around the hexagonal screw bolt 24 to apply force to the handles 11 to drive the clamping members 21. The positioning disk 23 further has a hexagonal aperture 233 for accepting a combination of the screw bolt 24 and the nut 25. When the positioning disk 23 is locked onto the clamping member 21, the handles 11 can be pivoted onto the first securing aperture 215 of the first limiting member 214 of the clamping member 21 via the center shaft 114 and the second securing aperture 235 of the second limiting member 234 of the positioning disk 23 such that handle 11 and the clamping member 21 are pivoted with each other. Furthermore, when the handle 11 is pivoted onto the clamping member 21, by pushing the trigger 123 of the control portion 12, the positioning face 124 of the control portion 12 engages with the positioning slot 216 of the clamping member 21 to limit and lock the handle 11 (as shown in FIG. 3). When the external force disappears, the trigger 123 is pushed back by the elastic member 126. Alternatively, when the handles 11 are locked, in order to unlock or change an opening angle, the trigger 123 needs to be pushed to make the positioning face 124 to escape from the positioning slot 216 (as shown in FIG. 5), and the handle 11 rotates around the center shaft 114 relative to the movements of the clamping unit 2 to change the direction of the handle 11, and the clamping members 21 open or close to provide different usage functions for pliers for C-shaped lock rings.

Figure 6:
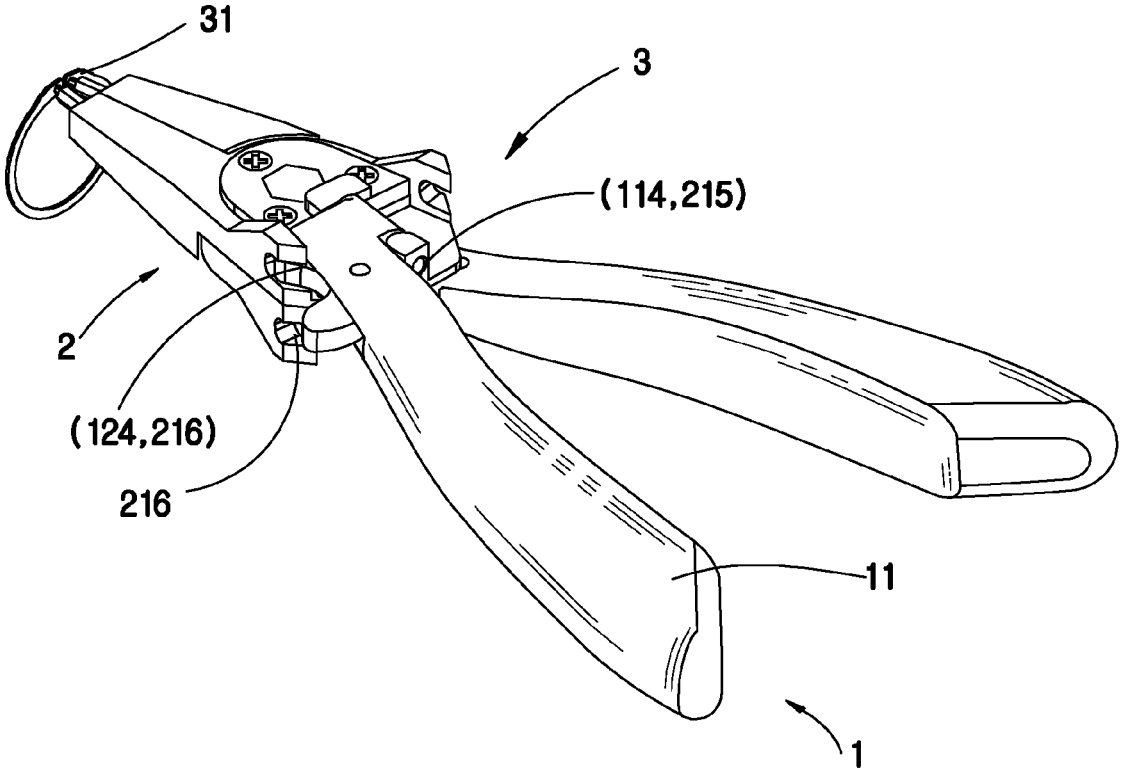
FIG. 6 is a schematic drawing of the pliers for C-shaped lock rings before being used according to the embodiment of the present invention.
Figure 7:
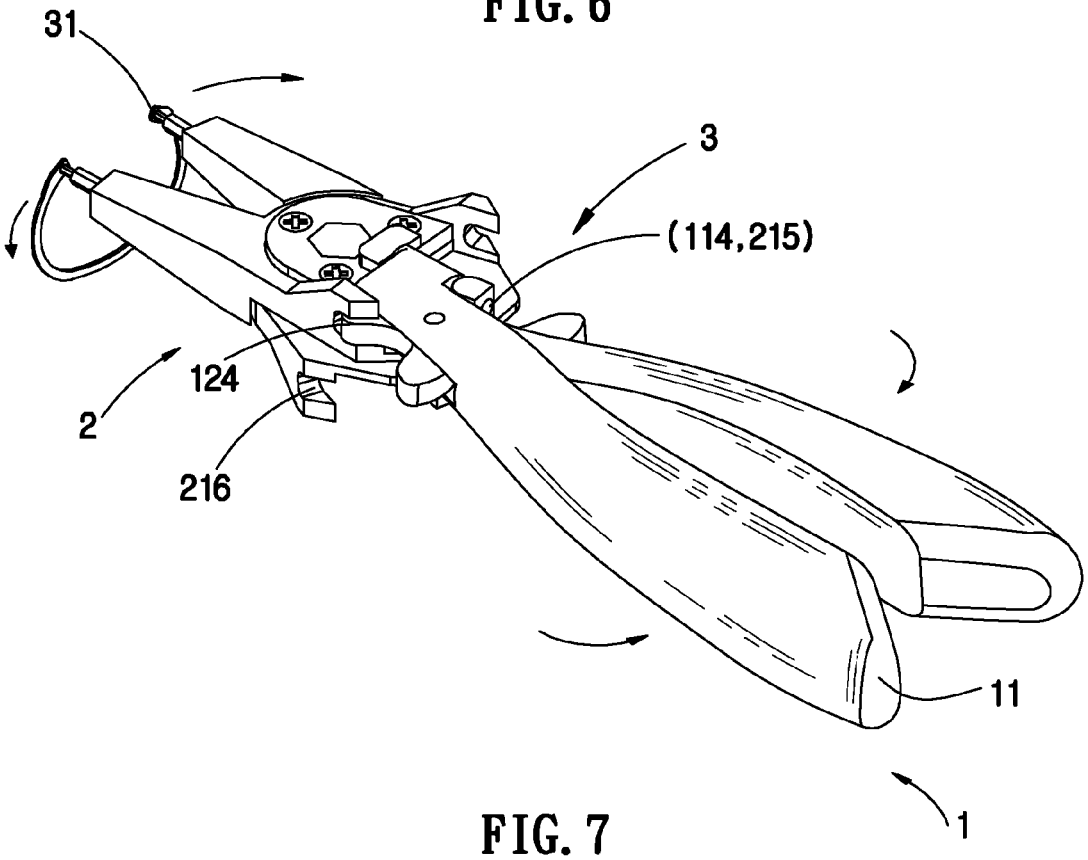
FIG. 7 is a schematic drawing of the pliers for C-shaped lock rings while being used according to the embodiment of the present invention.

Please refer to FIG. 5 to FIG. 7. When the user needs to use an external pliers for C-shaped lock rings 3, he or she first pushes the trigger 123 to release the positioning face 124 from the positioning slot 216 (as shown in FIG. 5), the handle 11 rotates around the center shaft 114 in both directions to open the clamping members 21 (as shown in FIG. 6), the trigger 123 is pushed again to make the positioning face 124 of the control portion 12 engage with the positioning slot 216 of the clamping member 21, the ring-holding member 22 is inserted in to a internal C-shaped lock ring 31, and the handles 11 are squeezed towards to the midline to open the clamping members 21 apart from each other, to stretch open an external C-shaped lock rings (as shown in FIG. 7).

Figure 8:
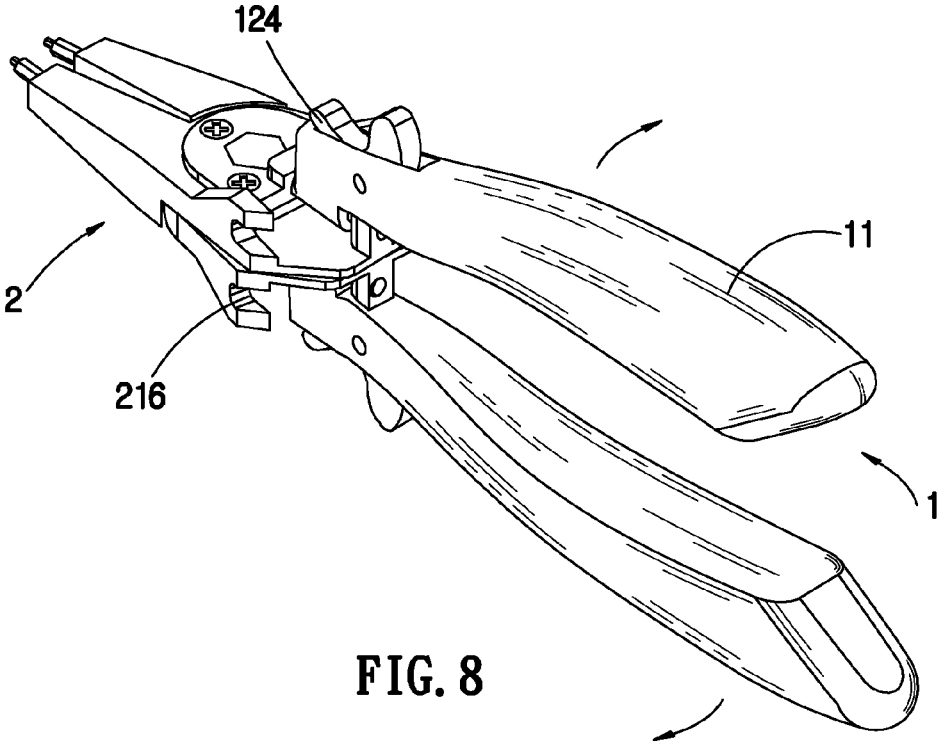
FIG. 8 is a movement schematic of the external pliers for C-shaped lock rings is switched into internal pliers for C-shaped lock rings according to the embodiment of the present invention.
Figure 9:
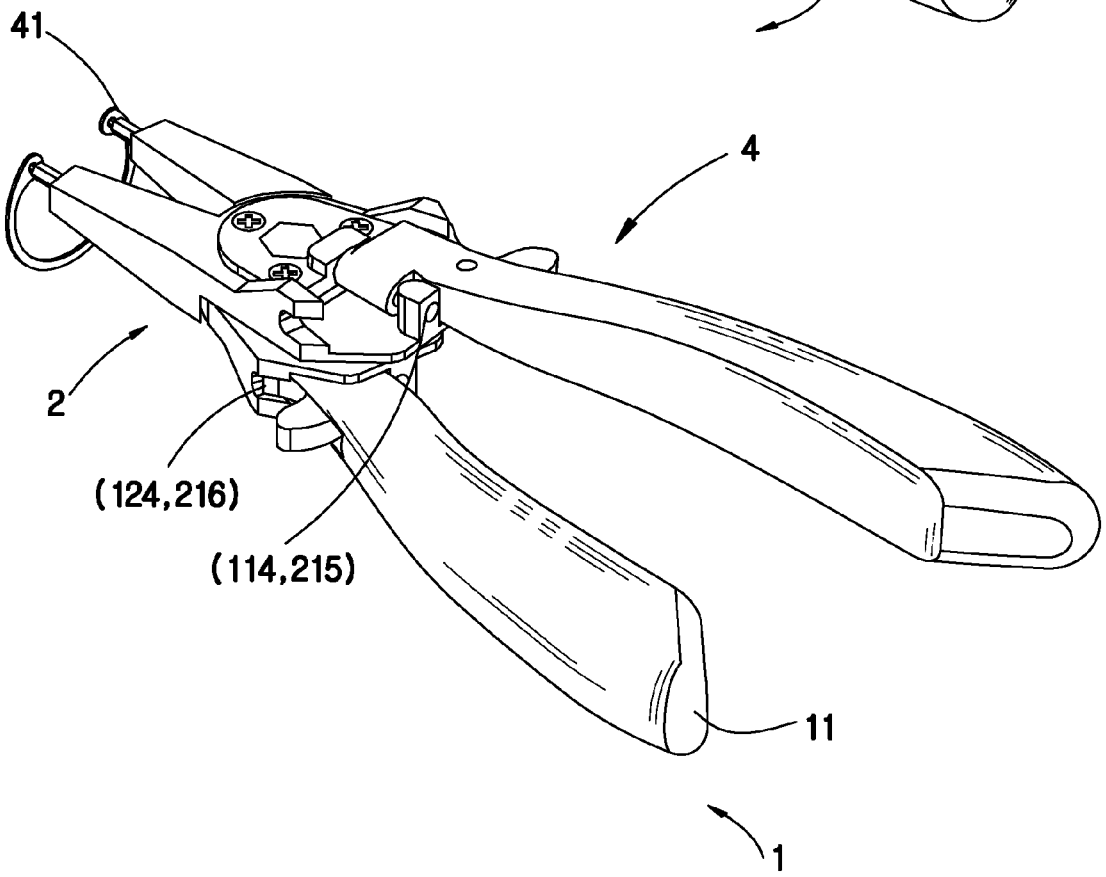
FIG. 9 shows the not-in-use internal pliers for C-shaped lock rings according to the embodiment of the present invention.
Figure 10:
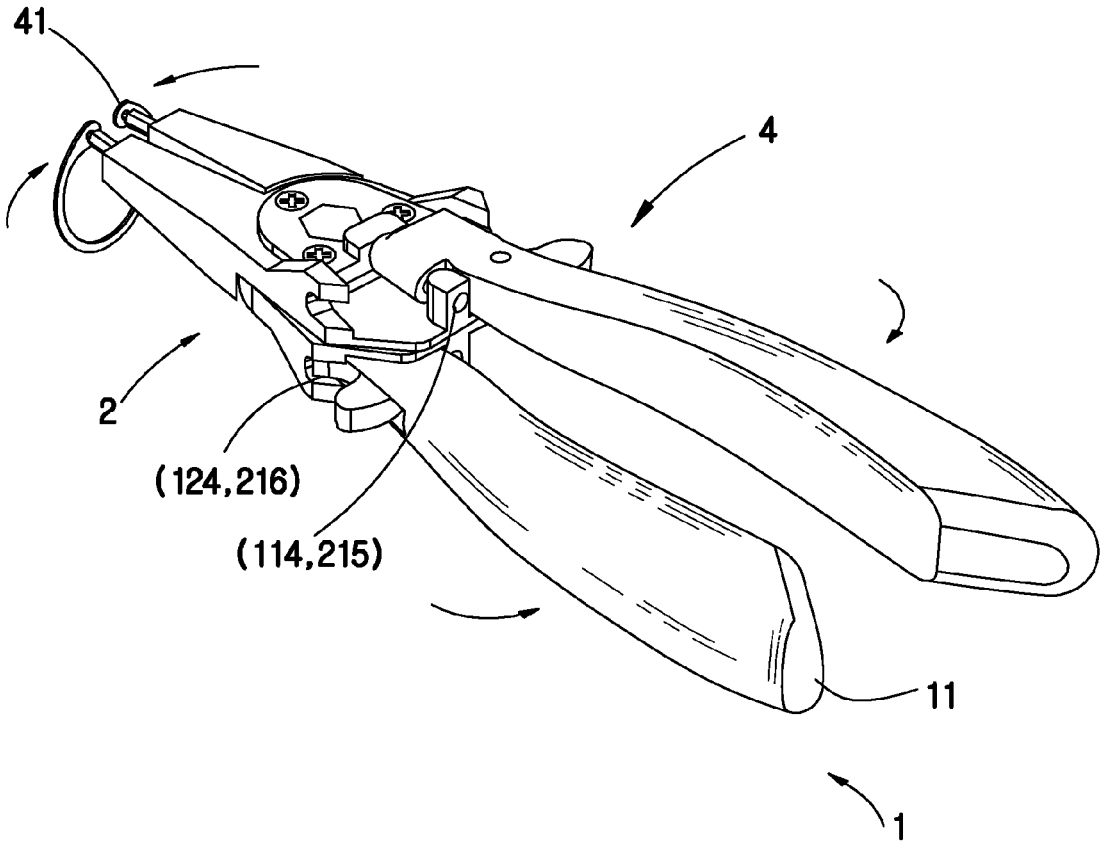
FIG. 10 shows the in-use internal pliers for C-shaped lock rings.

Please refer to FIG. 8 to FIG. 10. I'When the user needs to use an internal pliers for C-shaped lock rings 4, he or she first pushes the trigger 123 to release the positioning face 124 from the positioning slot 216 to release the handles 11, the handle 11 rotates around the center shaft 114 in both directions (as shown in FIG. 9) to make the positioning face 124 and the positioning slot 216 to engage with each other to lock the handles 11, the ring-holding members 22 are place inside of the internal C-shaped lock 41 and the handles 11 are squeezed towards to the midline to drive the clamping member 21 to close up, which closes the internal pliers for C-shaped lock rings 4 (as shown in FIG. 10).

Although the present invention has been explained in relation to its preferred embodiment, it is to be understood that many other possible modifications and variations can be made without departing from the spirit and scope of the invention as hereinafter claimed.

What is claimed is:

1. Pliers for C-shaped lock rings comprising: a holding unit and a clamping unit, wherein:

the holding unit is composed of two handles and a control portion, the handle is provided with a long slot at a side and a pivoting aperture inside the long slot for providing a pivoting point for the control portion, when an external force is applied onto the control portion, the control portion is capable of rotating in the long slot;

the clamping unit comprises two identical clamping members and a positioning disk, the clamping member has a first limiting member and a first securing aperture, a ring-holding member is pivoted above the clamping member and has a containment space; the containment space is used for accepting the positioning disk; the positioning disk has a second limiting member, a second securing aperture and a positioning slot on two outer sides of the two clamping members; the positioning disk is locked onto the clamping member; the handle utilizes the center shaft to be pivoted onto the first securing aperture and the second securing aperture such that the handle and the clamping member are pivoted with each other; and accordingly, when the control portion is released to engage with the positioning slot to lock the handle; when the control portion is pushed to disengage with the positioning slot, the handle rotate around the center shaft corresponding to the rotations of the clamping unit, such that the clamping members can be open or closed.

2. The pliers for C-shaped lock rings as claimed in claim 1, wherein the control portion further comprises an assembling aperture, a positioning rod, a trigger, a positioning face, a groove and an elastic member; the assembling aperture is located through a front portion of the control portion and accepts a positioning rod engaged with the pivoting aperture of the handle such that the control portion is accepted in the long slot.

3. The pliers for C-shaped lock rings as claimed in claim 2, wherein the groove is disposed at a bottom end of the trigger and used for accepting the elastic member.

* * * * *